US007578596B2

(12) United States Patent
Martin

(10) Patent No.: US 7,578,596 B2
(45) Date of Patent: Aug. 25, 2009

(54) SYSTEM AND APPARATUS FOR LIGHTING SWIMMING POOLS

(75) Inventor: Jean-Maurice Martin, Cambridge (CA)

(73) Assignee: Canadian General-Tower Limited, Cambridge, Ontario (CA)

( * ) Notice: Subject to any disclaimer, the term of this patent is extended or adjusted under 35 U.S.C. 154(b) by 0 days.

(21) Appl. No.: 11/753,695

(22) Filed: May 25, 2007

(65) Prior Publication Data

US 2008/0291661 A1 Nov. 27, 2008

(51) Int. Cl.
*F21V 33/00* (2006.01)

(52) U.S. Cl. ..... 362/101; 362/145; 362/267

(58) Field of Classification Search ..... 362/96, 362/101, 145, 147, 267, 318, 364, 365; 119/267; 4/496

See application file for complete search history.

(56) References Cited

U.S. PATENT DOCUMENTS

| | | | | |
|---|---|---|---|---|
| 1,909,404 | A * | 5/1933 | Horn | 362/101 |
| 3,192,379 | A | 6/1965 | De Garmo | |
| 3,955,076 | A | 5/1976 | Shaw | |
| 4,053,758 | A | 10/1977 | Shaw | |
| 4,433,366 | A | 2/1984 | Wade | |
| 4,503,489 | A | 3/1985 | Duerr et al. | |
| 4,587,599 | A | 5/1986 | St-Hilaire | |
| 5,144,545 | A | 9/1992 | Klitzing | |
| 5,416,932 | A * | 5/1995 | Ventrice | 4/496 |
| 5,483,428 | A | 1/1996 | Poppenheimer | |
| 5,903,933 | A | 5/1999 | Stegmeier | |
| 6,315,424 | B1 | 11/2001 | Hui | |
| 6,435,691 | B1 * | 8/2002 | Macey et al. | 362/267 |
| 6,971,760 | B2 | 12/2005 | Archer et al. | |
| 2004/0047145 | A1 | 3/2004 | Koren | |

* cited by examiner

*Primary Examiner*—Y My Quach Lee
(74) *Attorney, Agent, or Firm*—Bereskin & Parr LLP/SENCRL, srl.

(57) ABSTRACT

A lighting system for a swimming pool includes a sidewall sized and shaped to define a perimeter of the swimming pool, a liner for covering the sidewall and a bottom of the swimming pool so as to create a watertight cavity for receiving water, the liner including a light-transmitting portion, and a back-lighting apparatus connected to the sidewall behind the liner and configured to transmit light through the light-transmitting portion of the liner to illuminate the swimming pool. The back-lighting apparatus includes at least one housing connected to the sidewall behind the liner, the at least one housing having an opening positioned to register with the light-transmitting portion of the liner, at least one light source sized and shaped to fit within the housing for emitting light through the opening of the housing, and a light-transmitting cover shaped to cover the opening of the housing to protect the light source, wherein the light emitted from the light source is transmitted through the light-transmitting cover and the light-transmitting portion of the liner to illuminate the swimming pool.

11 Claims, 11 Drawing Sheets

SYSTEM AND APPARATUS FOR LIGHTING SWIMMING POOLS

TECHNICAL FIELD

The invention relates to lighting apparatus for pools, and in particular to systems and apparatus for illuminating swimming pools.

BACKGROUND

Systems and apparatus for illuminating pools, such as swimming pools or hot tubs, have become common and desired features for a number of different reasons, including facilitating swimming in reduced or low lighting conditions as well as providing increased aesthetic appeal. The systems and apparatus often include one or more electrical devices that are powered by an electrical power source to provide the desired illumination.

However, there are some risks associated with providing such electrical devices in close proximity to the water commonly found in pools, most notably the risk of electric shock to persons using the pools. As a result, pool lighting systems are typically subject to government regulations. For example, one common requirement is that the electrical components of a pool lighting system be either completely waterproof or else be positioned at a certain distance away from the pool water to minimize the risks of electric shock.

There are generally two types of pool lighting systems that have been developed in response to the challenges associated with illuminating pools. The first type provides underwater lighting, where one or more components of the system (such as a lamp) are provided with waterproof seals and are located near or below the waterline of the pool. The second type provides above water lighting, where the components of the system are located above the waterline, preferably at a substantial distance from the water, to minimize any risks of electrical shock.

One example of the first type of system is an underwater light described in U.S. Pat. No. 4,587,599 (St-Hilaire). St-Hilaire discloses a porthole assembly adapted to be mounted in an opening provided in a wall of a swimming pool. The assembly includes a lamp unit holder ring mounted to the outer face of the pool wall, and a transparent cover plate disposed on the inner face of the pool wall in direct contact with water in the swimming pool. Screws are used to secure the holder ring and the cover plate to the swimming pool wall in a watertight arrangement with the transparent cover plate so as to prevent pool water from contacting the screws. The porthole assembly may be mounted to the wall of an above ground swimming pool as well as to an in-ground swimming pool.

One problem with lights such as that of St-Hilaire is that during installation of the lights, the pool liner must often be cut and a hole formed in the wall of the pool. This can increase the complexity and costs associated with the manufacturing and/or the installation of the pool. Furthermore, since the cover plate is in direct contact with the pool water, the cover plate must be sealed over the porthole using a gasket or another sealing means to protect the electrical components behind the plate from exposure to pool water. Such seals can be cumbersome, and are often problematic when removing the cover to service or replace the lamp unit, as repeated removal of the cover can weaken or damage the gasket or seal. Furthermore, the gasket or seal may not be fully effective in preventing leaks, and over extended periods of time water may seep into the lamp unit, damaging the electrical components or resulting in increased risk of injury to persons using the pool.

One example of the second type of lighting systems is an above water light described in U.S. Pat. No. 5,903,933 (Stegmeier). Stegmeier solves some of the difficulties presented by the first type of lighting system by positioning the light above the water line away from direct contact with the pool water. Stegmeier discloses securing elongated lengths of track lighting in a coping face of a liner type swimming pool. The track supports elongated longitudinal lengths of fiber optic strips above the interior perimeter of a pool wall away from the surface of the water.

However, above water lights such as Stegmeier also have their disadvantages. To avoid direct contact with the water, the light fixtures of such lights are provided above the water surface and are generally visible to an observer, even when they are not in use, which may be undesirable. Furthermore, such lights may not provide sufficient illumination to the pool during use, particularly the underwater portions of the pool, given the distance of the light from the water. While greater illumination can be achieved using larger fiber optic lights, these types of lights can be unsightly and have a negative impact on the aesthetics of the pool.

Accordingly, there is a need for a pool lighting system and apparatus that provides improved illumination without negatively impacting the aesthetics of the swimming pool.

SUMMARY OF THE INVENTION

One aspect of the present invention is a lighting system for a swimming pool, having a sidewall sized and shaped to define a perimeter of the swimming pool, a liner for covering the sidewall and a bottom of the swimming pool so as to create a watertight cavity for receiving water, the liner including a light-transmitting portion, and a back-lighting apparatus connected to the sidewall behind the liner and configured to transmit light through the light-transmitting portion of the liner to illuminate the swimming pool.

The back-lighting apparatus of the lighting system may include at least one housing connected to the sidewall behind the liner, the at least one housing having an opening positioned to register with the light-transmitting portion of the liner, at least one light source sized and shaped to fit within the housing for emitting light through the opening of the housing, and a light-transmitting cover shaped to cover the opening of the housing to protect the light source, wherein the light emitted from the light source is transmitted through the light-transmitting cover and the light-transmitting portion of the liner to illuminate the swimming pool.

The sidewall may comprise a plurality of interconnected panels, each panel having a liner contact surface for engaging the liner and a recessed portion that defines the at least one housing. Each housing can include a ledge for receiving the light-transmitting cover, with the at least one light source being housed in the recessed portion.

The lighting system can be configured to provide a generally continuous distribution of light around at least a portion of a perimeter of the swimming pool. The at least one housing may define a channel extending around at least a portion of a perimeter of the swimming pool, with the at least one light source housed in the channel to provide a generally continuous distribution of light around at least a portion of the perimeter of the swimming pool.

The light-transmitting portion of the liner can include a decorative pattern having portions of varying light transmittance. The light-transmitting portion of the liner can be positioned proximate a water line when the swimming pool contains a pre-determined amount of water, such that an upper portion of the light-transmitting cover of the liner is above the waterline and a lower portion of the light-transmitting cover is below the water line.

The at least one light source may include a least one LED module. The light-transmitting cover may include a panel of light-transmitting material, such as a transparent or translucent material.

Another aspect of the present invention is a back-lighting apparatus for a swimming pool having a sidewall defining a perimeter of the swimming pool, a bottom of the swimming pool, and a waterproof liner for covering the sidewall and the bottom of the swimming pool. The back-lighting apparatus includes at least one housing connected to the sidewall behind the liner and having an opening positioned to register with a light-transmitting portion of the liner, at least one light source shaped and sized to fit within the housing for emitting light through the opening of the housing, and a light-transmitting cover shaped to cover the opening to protect the at least one light source, wherein the light emitted from the at least one light source is transmitted through the light-transmitting cover and the light-transmitting portion of the liner to illuminate the swimming pool.

A further aspect of the present invention is a system for forming an illuminated swimming pool, the swimming pool having a waterproof liner for creating a watertight cavity for receiving water, including a plurality of panels shaped to be interconnected to form a sidewall of the swimming pool. Each panel has a front wall defining a liner contact surface for engaging the liner, and a recessed portion connected to and offset from the front wall, the recessed portion having an opening positioned to register with a light-transmitting portion of the liner. The system also includes at least one light source sized and shaped to fit within the recessed portion of each panel for emitting light through the opening, and a light-transmitting cover shaped to cover the opening of the recessed portion to protect the light source, wherein the light emitted from the light source is transmitted through the light-transmitting cover and the light-transmitting portion of the liner to illuminate the swimming pool. Each panel may have vertical side flanges extending rearwardly from side edges of the front wall, the vertical side flange configured for interconnecting the panels together to form a perimeter of the swimming pool.

Other aspects and features of the invention will become apparent to those ordinarily skilled in the art upon review of the following description of some exemplary embodiments.

BRIEF DESCRIPTION OF THE DRAWINGS

For a better understanding of the embodiments, and to show more clearly how they may be carried into effect, reference will now be made, by way of example, to the accompanying drawings, in which.

DETAILED DESCRIPTION OF THE INVENTION

Figure 1:
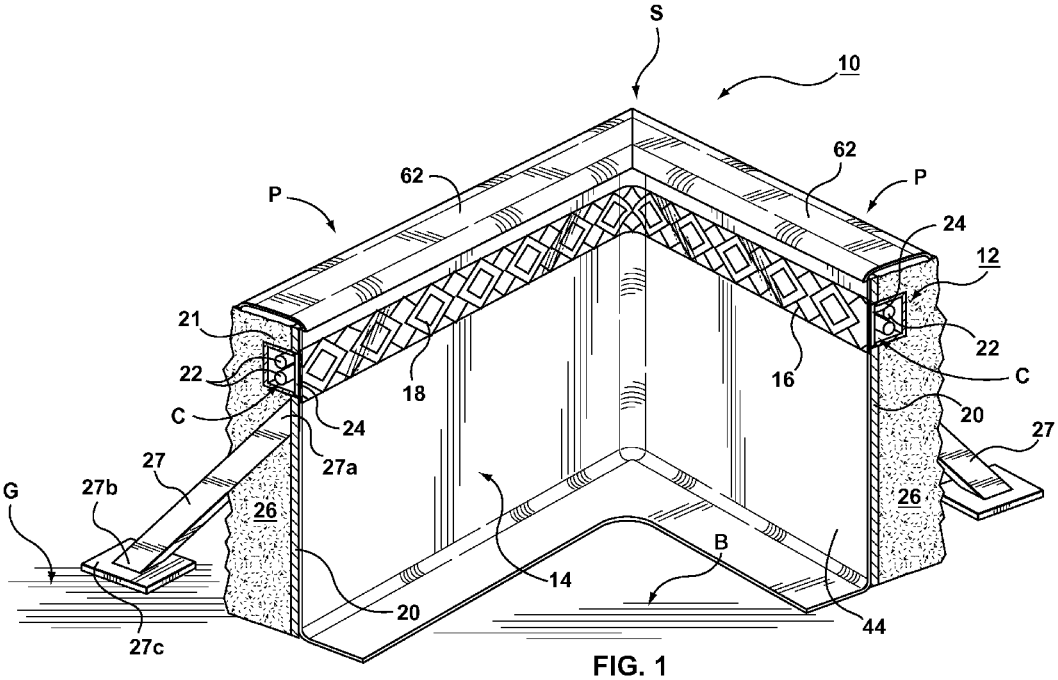
FIG. 1 is a perspective view of a corner section of a swimming pool having a lighting system installed according to one embodiment of the invention.

Referring to FIG. 1, illustrated therein is a corner section of a swimming pool 10 having a lighting system shown generally as 12 made in accordance with one embodiment of the invention. It will be appreciated that while specific reference is made to swimming pools, the systems and apparatus described herein could be used with other artificial pools, such as hot tubs, ponds or other man-made pools.

The lighting system 12 comprises a plurality of vertical sidewall members 20 sized and shaped to define a sidewall of the swimming pool 10, a liner 14 for covering the sidewall and a bottom B of the swimming pool 10 so as to create a watertight cavity for receiving water W in the swimming pool 10, the liner 14 having a light-transmitting portion 16, and a back-lighting apparatus 21 located behind the liner 14 and configured for transmitting light through the light-transmitting portion 16 of the liner 14 to illuminate the swimming pool 10. As described in greater detail below, the back-lighting apparatus 21 generally includes a housing 28 having an opening proximate the liner 14, one or more lighting sources 22 located in the housing 28, and a light-transmitting cover 24 for closing the opening of the housing 28 to protect the light sources 22.

Sidewall members 20 of the lighting system 12 generally comprise a plurality of vertically oriented panels extending upwardly from a ground surface G to define a generally continuous outer perimeter P of the swimming pool 10. The sidewall members 20 define the overall shape of the swimming pool 10, and act as a support for the liner 14 and the back-lighting apparatus 21.

Figure 3:
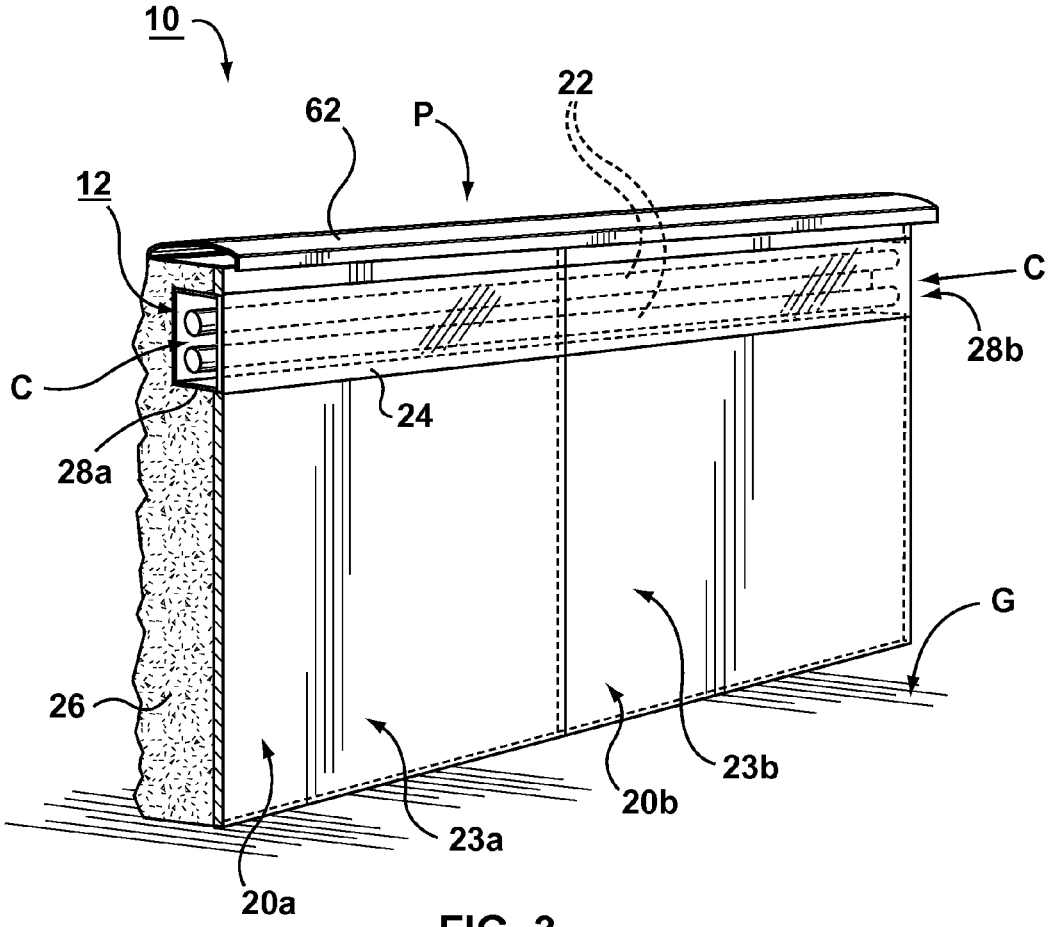
FIG. 3 is a perspective view of a section of the swimming pool of FIG. 1 showing the liner removed.

The sidewall members 20 can generally having any desired shape according to the design of any particular swimming pool 10. In some embodiments, the sidewall members 20 can have a generally planar shape, for example exemplary first sidewall portion 20*a* and second sidewall portion 20*b*, as shown in FIG. 3. Planar sidewall members 20 can be configured to provide the swimming pool 10 with a generally rectangular shape, as shown in FIG. 1. In other embodiments, the sidewall members 20 can have curved or other shapes according to the particular design of the swimming pool 10. For example, the swimming pool 10 can have a circular or a kidney shape formed using sidewall members 20 having various curved shapes.

To maintain their vertical alignment with respect to the ground surface G, the sidewall members 20 can be supported from behind in some embodiments using backfill 26 and one or more braces 27. Each brace 27 comprises a longitudinal member extending from an upper end 27*a*, where the brace 27 engages the sidewall portion 20 at an angle, to a lower end 27*b* having a foot portion 27*c* resting on the ground surface G. The braces 27 can be provided at predetermined spaced locations along outer perimeter P of the swimming pool 10 according to the design of the particular swimming pool 10 to provide for even distribution of the loads on the sidewall members 20. The backfill 26 and braces 27 assist in providing lateral support for the vertical sidewall members 20 to stabilize the swimming pool 10 when water is added.

It will be appreciated that in some embodiments, the swimming pool 10 can be an in-ground pool, while in other embodiments, the swimming pool 10 can be an above-ground pool. Accordingly, the configuration of the sidewall members 20, the backfill 26 and the braces 27 will vary according the type of swimming pool 10 being provided.

In some embodiments, the upper end 20*c* of the sidewall members 20 can be covered by a finishing trim 62 for protecting the sidewall members 20, and/or backfill 26, braces 27 and back-lighting apparatus 21. The finishing trim 62 can be any suitable resilient material, such as a galvanized steel or plastic, and can be designed to provide the swimming pool 10 with an aesthetically pleasing look. In some embodiments, such as where the swimming pool 10 is an in-ground pool, instead of the finishing trim, the upper end 20*c* of the sidewall members 20 could be covered using another suitable cover, such as a permanent or semi-permanent walkway formed of a concrete, patio stones, or other material.

As best shown in FIG. 3, the sidewall members 20 each generally include an inner liner contact surface 23 that is shaped for receiving the liner 14. For example, the first sidewall portion 20*a* has a first liner contact surface 23*a*, and the second sidewall portion 20*b* has a second liner contact surface 23*b*.

The liner 14 is typically a continuous and flexible watertight membrane or sheet that is made of a plastic, such as polyvinyl chloride (PVC), a rubber, or other suitably resilient material. In some embodiments, the liner is between 12 mm to 30 mm thick. It will be appreciated that in other embodiments the liner 14 could be of different thicknesses according to the needs of a particular application. For example, where it is desirable to have a more rugged liner 14, the liner 14 could be made of a thicker plastic material.

The liner 14 is generally shaped and sized to overlie the sidewall members 20 (engaging with the liner contact surfaces 23) around the perimeter P of the swimming pool 10 and rest on the bottom B of swimming pool 10. In this manner, the liner 14 functions so as create a watertight cavity for retaining water in the swimming pool 10.

The liner 14 includes at least one light-transmitting portion 16 located so as to register at least partially with the lighting system 12 so that light emitted from the lighting system 12 can pass through the liner 14, backlighting the liner 14 and illuminating the swimming pool 10.

The light-transmitting portion 16 is generally a portion of the liner 14 having material characteristics such that a predetermined amount of light can pass therethrough. For example, in some embodiments, the light-transmitting portion 16 can be a transparent portion of liner 14. In other embodiments, the light-transmitting portion 16 can be a translucent portion of liner 14.

In some embodiments, the liner 14 can include one or more decorative patterns 18, such as a tile motif or other design. In some embodiments, the light-transmitting portion 16 and decorative pattern 18 are at least partially aligned, such that light passing through the light-transmitting portion 16 will illuminate all or a portion of the decorative pattern 18. The decorative pattern 18 may include portions of varying light transmittance, including various colors and shades as well as portions that are translucent, transparent, or opaque, which may further enhance the aesthetics of the swimming pool 10.

In some embodiments, the liner 14 may be fabricated from a clear or colored vinyl sheet (such as PVC), which may then be printed or dyed with any desired colors or patterns. For example, the liner 14 may have a solid color or pattern 44 on a majority of the liner 14 and the decorative pattern 18 printed on one or more locations. In other embodiments, the liner 14 can be provided without any decorative pattern. For example, in some embodiments, the liner 14 may comprise clear, white and/or colored portions, or be partially or mostly opaque.

Figure 2:
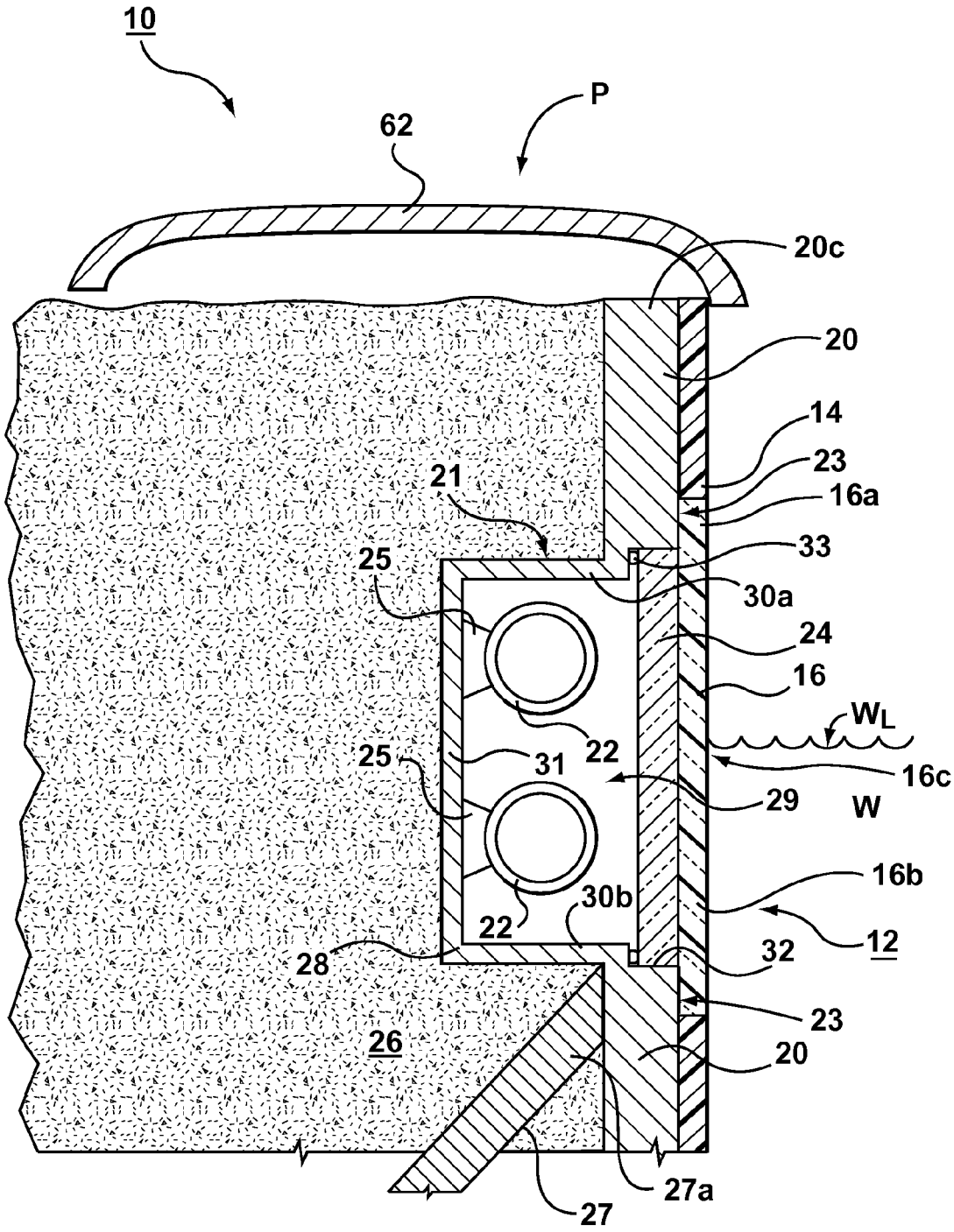
FIG. 2 is a cross-sectional view of a section of the swimming pool of FIG. 1.

With reference now to FIG. 2 in particular, the lighting system 12 generally includes the back-lighting apparatus 21 connected to the sidewall members 20. The back-lighting apparatus 21 is positioned behind the liner 14 (on the side of the liner 14 away from water W in the swimming pool 10) such that the back-lighting apparatus 21 is protected from exposure to the water W by the waterproof liner 14, which extends upward past the waterline $W_L$ to a location proximate the finishing trim 62.

The back-lighting apparatus 21 generally comprises the housing 28 having an opening proximate the liner 14, one or more lighting sources 22 located in the housing 28, and the light-transmitting cover 24 for closing the opening of the housing 28 to protect the light sources 22. As shown in FIG. 2, the opening of the housing 28 is generally sized and located to register with at least a portion of the light-transmitting portion 16 of the liner 14.

In some embodiments, the housing 28 is generally rectangular in cross section and includes opposing horizontal top wall 30*a* and bottom wall 30*b* that extend rearward from the opening, away from the liner 14 and into the backfill 26. A vertical back wall 31 connects the top wall 30*a* and bottom wall 30*b*.

In some embodiments, the housing 28 can be provided as a separate fixture that is secured in an aperture provided in the sidewall members 20. Alternatively, the housing 28 can be a recessed portion of the sidewall members 20 that is integrally formed within the sidewall members 20. For example, the top wall 30*a* and bottom wall 30*b* and vertical back wall 31 may be recessed within the sidewall portion 20 where the sidewall portion 20 comprises a panel made of stamped metal or extruded piece of plastic, as discussed in more detail below.

The back-lighting apparatus 21 also includes one or more light sources 22 for generating light, the light sources 22 being located in the recessed portion of the housing 28. The light sources 22 are configured to emit light towards the opening of the housing 28 though the light-transmitting portion 16 of the liner 14 to illuminate the swimming pool 10. The light sources 22 are mounted on track members 25 that are secured to the vertical wall 31.

The light sources 22 can include any suitable type of electrical lighting, for example strip or fluorescent lighting, incandescent bulbs, light emitting diode modules (LED modules), or fiber optic strips. The light sources 22 can provide light of a particular color or several colors, which can enhance aesthetics of the swimming pool 10 or improve illumination. The light sources 22 can be powered by a low-voltage, high-current power source (not shown) so as to reduce the risk of injury from electric shock to persons using the swimming pool 10.

In some embodiments, it is generally desirable that the light sources 22 provide a generally continuous distribution of light around at least a portion of the perimeter P of the swimming pool 10. To facilitate this, the housings 28 of the back-lighting apparatus 21 of each sidewall member 20 are generally provided in alignment with each other, as shown in FIGS. 1 and 3. For example, as shown in FIG. 3, first housing 28*a* of the first sidewall portion 20*a* is generally aligned with second housing 28*b* of the second sidewall portion 20*b*, and can be said to generally define a "channel" C running along the entirety of the first sidewall portion 20*a* and second sidewall portion 20*b*.

Similarly, as shown in FIG. 1, "channel" C can be continuous through corner section S of the swimming pool 10. In this manner, the lighting system 12 can be provided around the entirety of, or at least a portion of, the perimeter P of the swimming pool 10, to provide continuous backlighting of the light-transmitting portion 16 of the liner 14. The "channel" C also provides a conduit for housing any electrical wiring necessary for connecting the light sources 22 to an electrical power supply (not shown), such as a residential or commercial power supply, or an alternative supply such as a wind turbine or solar generator.

In some embodiments, as shown in FIG. 3, "channel" C is generally horizontal with respect to the ground surface G. It will be appreciated that channel "C" can be disposed at an angle with respect to the ground surface G, and may not run continuously around the perimeter P of the swimming pool 10, but may only extend along a portion of the sidewall of the swimming pool 10. In some embodiments, a plurality of channels can be provided.

Each back-lighting apparatus 21 also includes light-transmitting cover 24 for positioning at the opening of the housing 28. The light-transmitting cover 24 is preferably made of a panel of translucent or transparent material, such as a polycarbonate or acrylic glass (i.e. polymethyl methacrylate), to allow the light generated by the light sources 22 to pass easily therethrough for backlighting the liner 14. In some embodiments, the cover 24 may be tinted to illuminate swimming pool 10 with a particular color of light to further improve the aesthetic appeal of the swimming pool 10.

As shown in FIG. 2, the walls 30 of the housing 28 may include one or more ledges 32 located proximate the liner 14 for receiving the cover 24. The ledges 32 typically have a depth corresponding to the thickness of cover 24 such that the cover 24 will rest generally flush with the outer liner contact surface 23 of sidewall members 20 (such as 23*a* and 23*b*, as best shown in FIGS. 2 and 3) to form a flat continuous surface for receiving the liner 14. In some embodiments, the light cover 24 can be attached to the ledges 32 of the sidewall members 20 using a bead of adhesive 33 or removable fasteners, such as screws or snap fittings, which can inhibit the cover 24 shifting after the liner 14 has been installed in the swimming pool 10.

Once in place, the cover 24 generally serves as a rigid protective barrier for protecting the light sources 22 while providing a continuous surface for receiving liner 14. Since liner 14 is positioned between cover 24 and the water W in the swimming pool 10, it is not necessary to completely seal the cover 24 to the sidewall members 20 or to any other part of the back-lighting apparatus 21 to prevent water from leaking into the housing 28 and contacting the back-lighting apparatus 21, as the waterproof liner 14 covers and seals the back-lighting apparatus 21 from pool water W.

The lighting system 12 thus lends itself towards relatively simple installation, without the need to cut holes in the liner 14 during installation. Furthermore, lighting system 12 can also provide aesthetic appeal by providing illumination of the swimming pool 10 without having any light apparatus visible to an observer when not is use.

As best shown in FIG. 2, in some embodiments the light-transmitting portion 16 has a mid-point 16*c* typically be located at the water surface $W_L$ when a pre-determined amount of water W is in the swimming pool 10 such that during use, an upper portion 16*a* of the light-transmitting portion 16 lies above the water surface $W_L$ while a lower portion 16*b* of the light-transmitting portion 16 lies below the water surface $W_L$. This configuration allows light from the back-lighting apparatus 21 to be directed concurrently both above and below the water surface $W_L$ to provide a desired illumination of the swimming pool 10.

In other embodiments, the light-transmitting portion 16 may be located entirely above or below the water surface $W_L$ during use, according to a desired lighting application. For example, lighting the swimming pool 10 entirely from above the water surface $W_L$ may enhance the aesthetics of the swimming pool 10, while lighting the swimming pool 10 entirely from below the water surface $W_L$ may enhance illumination of the water W of the swimming pool 10 for facilitating swimming in low ambient light.

Generally, the sidewall members 20 can be formed of any suitably rigid material sufficient to resist deflection and define the perimeter P of the swimming pool 10 when water W is provided. In some embodiments, the sidewall members 20 comprise one or more panels members formed of a suitable material, such as a concrete (including gunite or shotcrete), sheet metal (such as galvanized steel), thermoplastics (such as a polycarbonate), thermosets, or composite materials (such as carbon fiber or fiberglass).

As described in greater detail below, in some embodiments, the sidewall members 20 can be formed using one or more interconnected pre-formed panels. For example, turning to FIG. 3, exemplary sidewall members 20*a*, 20*b* can each be separate panel members that have been interconnected to form a portion of the sidewall of the swimming pool 10.

FIG. 3 also shows the light-transmitting cover 24 covering the light sources 22 and connected to the exemplary sidewall members 20*a*, 20*b*. In some embodiments, the cover 24 can be provided as a continuous member extending across multiple sidewall members 20*a*, 20*b*. In other embodiments, each sidewall portion 20*a*, 20*b* can be provided with its own light-transmitting cover 24, which may be particularly advantageous where the sidewall members 20 are of a curved shape.

It will be noted from FIG. 3 that the cover 24 and liner contact surface 23 form a generally flush surface, in this case a planar surface, for receiving the liner 14. In other embodiments, the cover 24 and liner contact surface 23 may form an uneven, non-planar surface. In such embodiments, this uneven surface can be accommodated by providing the liner 14 having a corresponding non-uniform cross-section.

Figure 4:
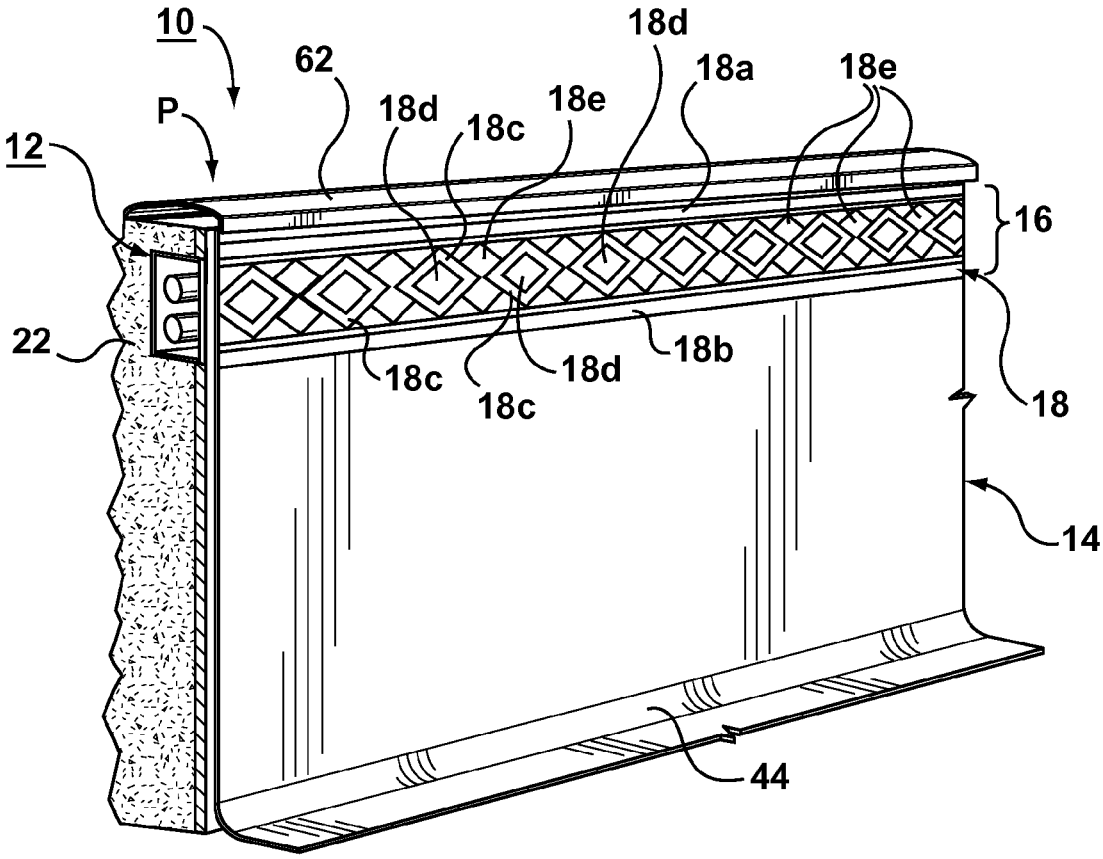
FIG. 4 is a perspective view of the section of the swimming pool of FIG. 3 showing the liner having a decorative pattern.

Turning now to FIG. 4, a section of the swimming pool 10 is shown with the liner 14 installed. The liner 14 covers the light-transmitting cover 24 of the back-lighting apparatus 21, preventing any water W in the swimming pool 10 from engaging the back-lighting apparatus 21. The liner 14 also provides the light-transmitting portion 16 in alignment with the back-lighting apparatus 21 to allow the light emitted by the back-lighting apparatus 21 to pass through the light-transmitting portion 16 to backlight the liner 14 and illuminate the swimming pool 10.

In some embodiments, the liner 14 can include the decorative pattern 18, shown here as a tile mosaic. For example, as shown in FIG. 4, the decorative pattern 18 may extend horizontally around the perimeter P of swimming pool 10 as a strip that is generally coincident with the light-transmitting portion 16 of the liner 14. In one embodiment, the decorative pattern 18 may include two tile strips 18*a*, 18*b*, a series of large diamonds 18*c*, a series of small diamonds 18*d* positioned within the large diamonds 18*c*, and tile borders 18*e* surrounding the large diamonds 18*c*. The large diamonds 18*c* are located between the two tile strips 18*a*, 18*b*, which in some embodiments are separated by approximately 10 cm. The arrangement of large diamonds 18*c*, small diamonds 18*d* and tile borders 18*e* can be continuously repeated between tile strips 18*a*, 18*b* around the perimeter P of swimming pool 10.

In some embodiments, each portion 18*a*, 18*b*, 18*c*, 18*d*, 18*e* of the decorative pattern 18 can be a different color or have varying light transmittance properties. In other embodiments, different decorative patterns may be used, for example, decorative pattern 18 may feature waves, snowflakes, fish, flowers or other aesthetically pleasing patterns instead of a diamond pattern.

Figure 5:
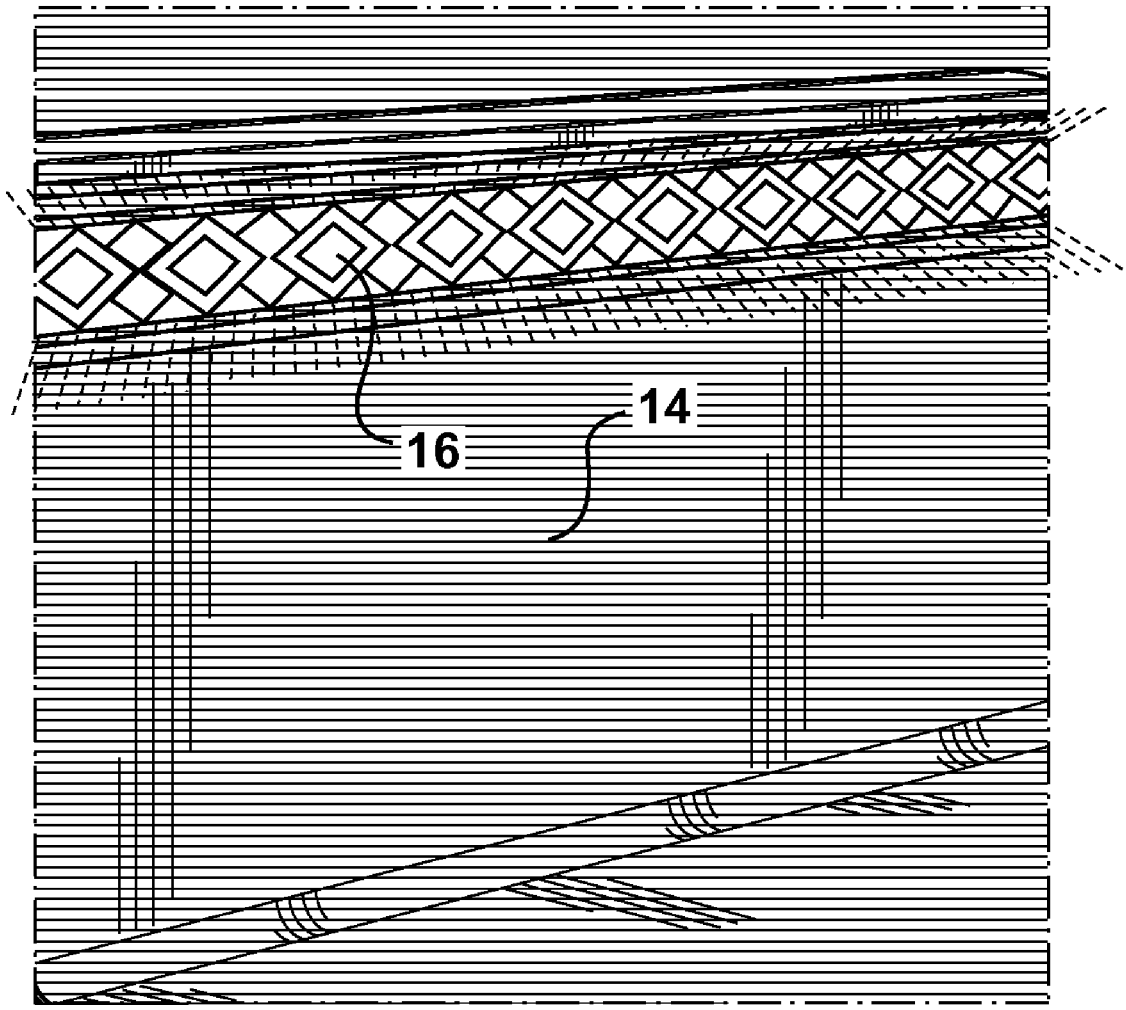
FIG. 5 is a perspective view of the pool wall and liner of FIG. 4 showing the liner being backlit in low ambient light conditions.

During use of the lighting system 12, the back-lighting apparatus 21 illuminates the swimming pool 10 by backlighting the liner 14, which can provide increased aesthetic qualities to the swimming pool 10 as well as facilitate use of the swimming pool 10 in low ambient light conditions, such as at night. For example, as shown in FIG. 5, when the lighting system 12 is operated in low ambient light conditions, the light-transmitting portion 16 of the liner is illuminated, providing the swimming pool 10 with a desired level of illumination. In some embodiments, the varying light transmittance provided by the decorative pattern 18 can be visually appealing to an observer.

Figure 6:
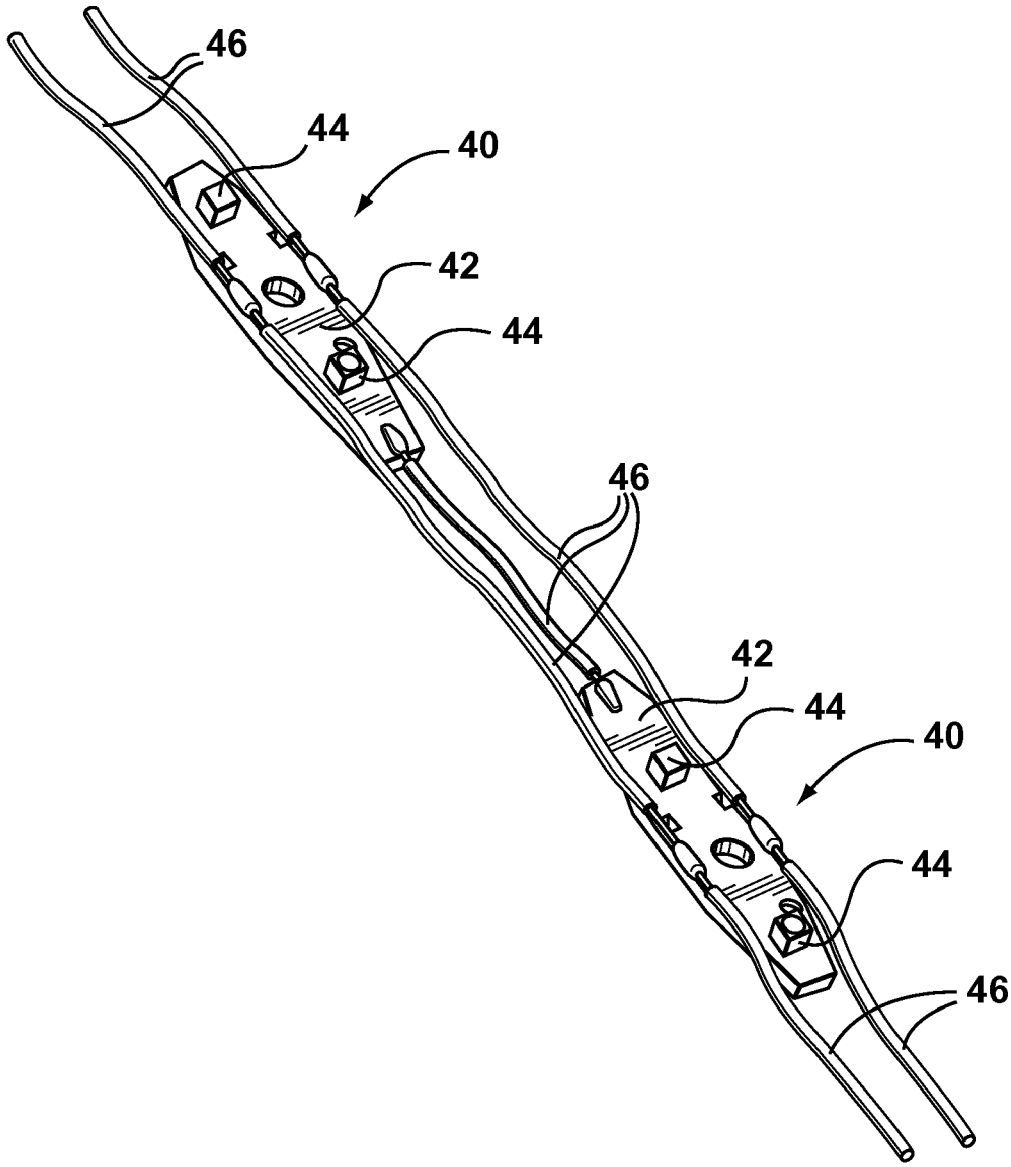
FIG. 6 is a perspective view of LED modules for use as a lighting source for the lighting system of FIG. 1.

Turning now to FIG. 6, illustrated therein is a strip of LED modules 40 that may be usable as a light source 22. Each LED module 40 includes an LED body 42 connected to one or more LEDs 44. LEDs 44 can be any color of LED according to the desired needs of a particular lighting application. For example, in some embodiments the LEDs 44 could be white, green, blue, red or any other desired color.

As shown, multiple LED modules 40 can be connected together and coupled to an electrical power source (not shown) by wires 46. It will be appreciated that, during use with the lighting system 12, the wires 46 of the LED modules 40 can be provided in the "channel" C to connect to the power source. In other embodiments, the housings 28 of the sidewall members 20 can include one or more openings that allow the wires 46 to pass through the sidewall members 20 and into the backfill 26 to be coupled to the electrical power source. In some embodiments, the LED modules 40 could be OSRAM SYLVANIA™ LED modules.

Figure 7A:
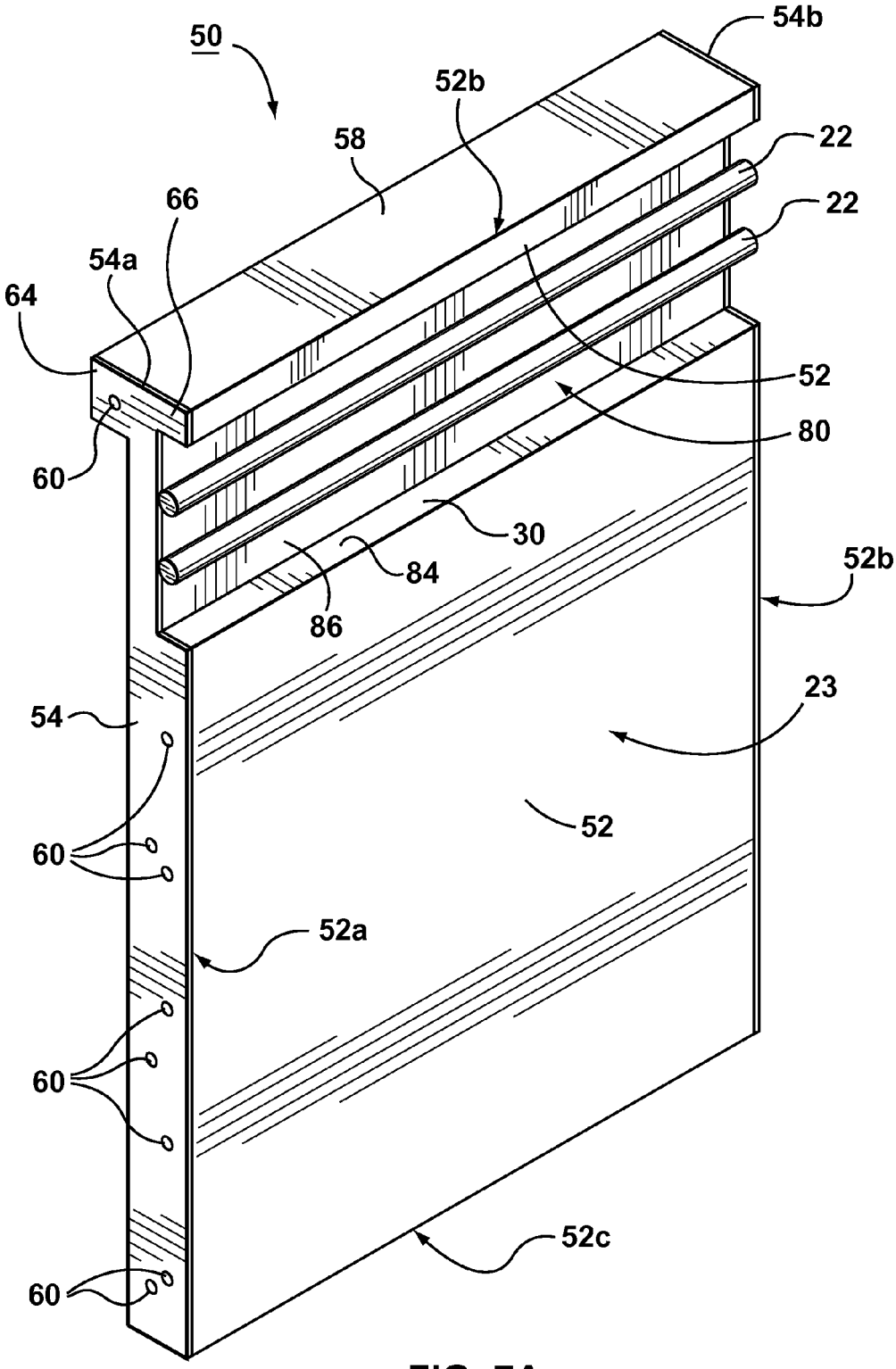
FIG. 7A is a front perspective view of a panel for forming a swimming pool having a lighting system according to one embodiment, shown with the light sources attached but without the cover.
Figure 7B:
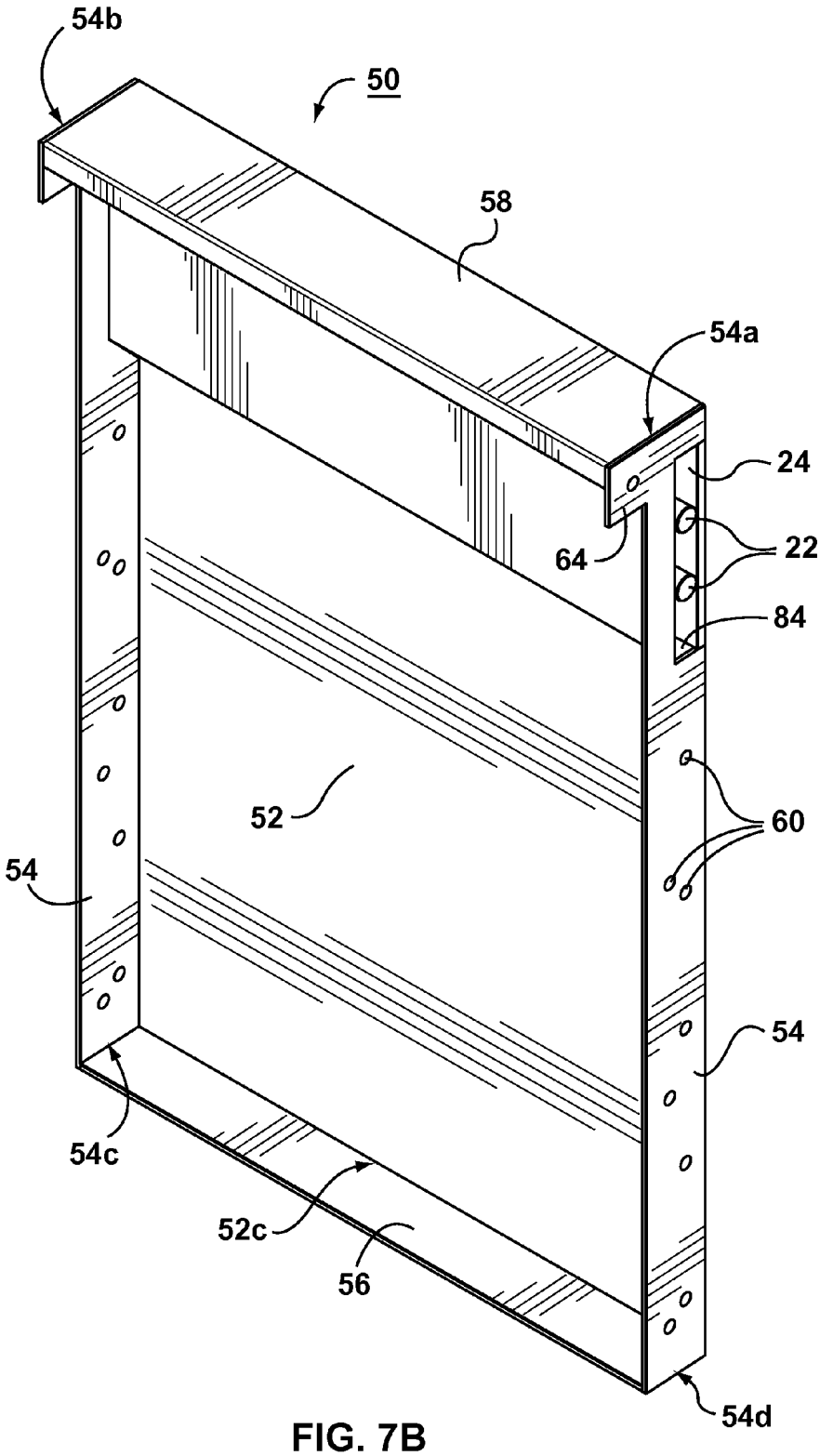
FIG. 7B is a rear perspective view of the panel of FIG. 7A shown with the cover and light sources attached.

Turning now to FIGS. 7A to 7D, there is shown a panel 50 for forming the sidewall members 20 of the swimming pool 10 made in accordance with one embodiment of the present invention. The panel 50 includes a front wall 52 (shown here as a flat, generally planar portion), which generally provides the liner contact surface 23 for engaging the liner 14. The panel 50 also includes a pair of opposing vertical side flange members 54 (as best shown in FIG. 7B) extending rearwardly from side edges 52*a*, 52*b* of the front wall 52, a bottom flange member 56 extending rearwardly from bottom edge 52*c* of the front wall 52, and a top flange member 58 extending rearwardly from a top edge 52*d* of the front wall 52 The side flange members 54 are connected to the top flange member 58 at upper edges 54*a*, 54*b*, and to the bottom flange member 56 at lower edges 54*c*, 54*d*.

The side flange members 54, bottom flange member 56 and top flange member 58 assist the front wall 52 in providing rigidity to the panel 50, with the bottom flange member 56 generally resting on the ground surface G, and the upper member 58 generally defining the top of the sidewall portion 20 during use.

In some embodiments, the top flange member 58 is wider than the side flanges 54 and the side flanges 54 include a rear protrusion 64 extending rearwardly from the side flange members 54 to accommodate the wider top flange member 58. The rear protrusion 64 can provide additional support to the top flange member 58 and to the finishing trim 62 during use, as well as facilitate interconnection of multiple panels 50.

Figure 7C:
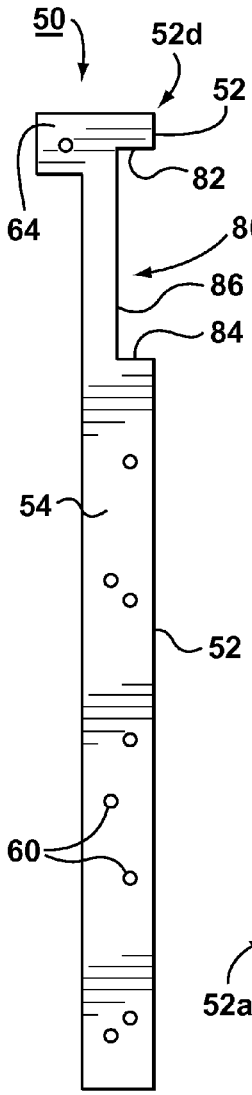
FIG. 7C is a side elevation view of the panel of FIG. 7A with the cover and light sources removed.
Figure 7D:
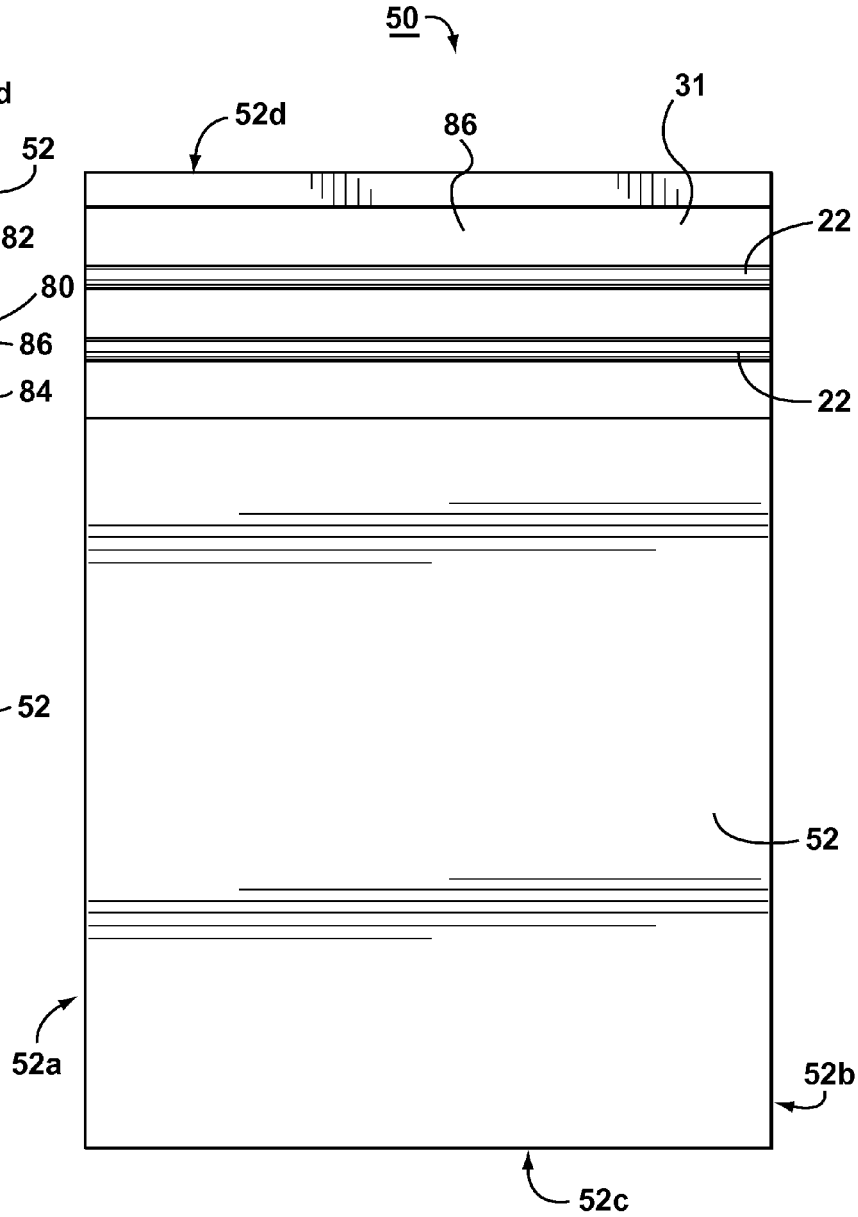
FIG. 7D is a front elevation view of the panel of FIG. 7A with the cover removed.

As best shown in FIGS. 7A and 7C, the front wall 52 of the panel 50 also includes a recessed portion 80 having opposing top wall 82, bottom wall 84, and a rear vertical wall 86 offset rearwardly from the front wall 52. The top wall 82, bottom wall 84 and rear wall 86 of the recessed portion 80 cooperate to define the housing 28 of the lighting apparatus 21 for receiving the light sources 22 and the cover 24. As shown in FIGS. 7A and 7C, the recessed portion 80 is proximate the top flange member 58. It will be appreciated, however, that the recessed potion 80 could be located at different locations in the panel 50.

The side flanges 54 have cut-outs between the top flange member 58 and the bottom flange member 56 to register with the recessed portion 80. In some embodiments, the side flange members 54 comprise a plurality of through holes 60 which allow multiple panels 50 to be connected side by side (using lag bolts or other suitable fasteners) to form the perimeter P of the swimming pool 10. In other embodiments, the side flange members 54 can be fastened using any other suitable techniques, such as by the use of slotted tabs or other techniques.

In some embodiments, the panel 50 (including the front wall 52, side flange members 54, bottom flange member 56, and top flange member 58) is made of sheet metal, such as 18-gauge galvanized steel. The panel 50 can be made by cutting, folding, and joining the sheet of metal (such as by welding, brazing, bolting or riveting) to form the front wall 52, the side flange members 54, the bottom flange member 56, the top flange member 58 and the recessed portion 80, using techniques as known in the art.

In other embodiments, the panel 50 can be formed of any other suitable material. For example, the panel 50 could be formed of a molded thermoplastic or thermoset, a carbon fiber, or a fiberglass. Furthermore, as described above, while the panel 50 shown is generally planar in shape, other configurations, such as curved panels or panels having built-in corners or other shapes could also be provided.

Figure 8A:
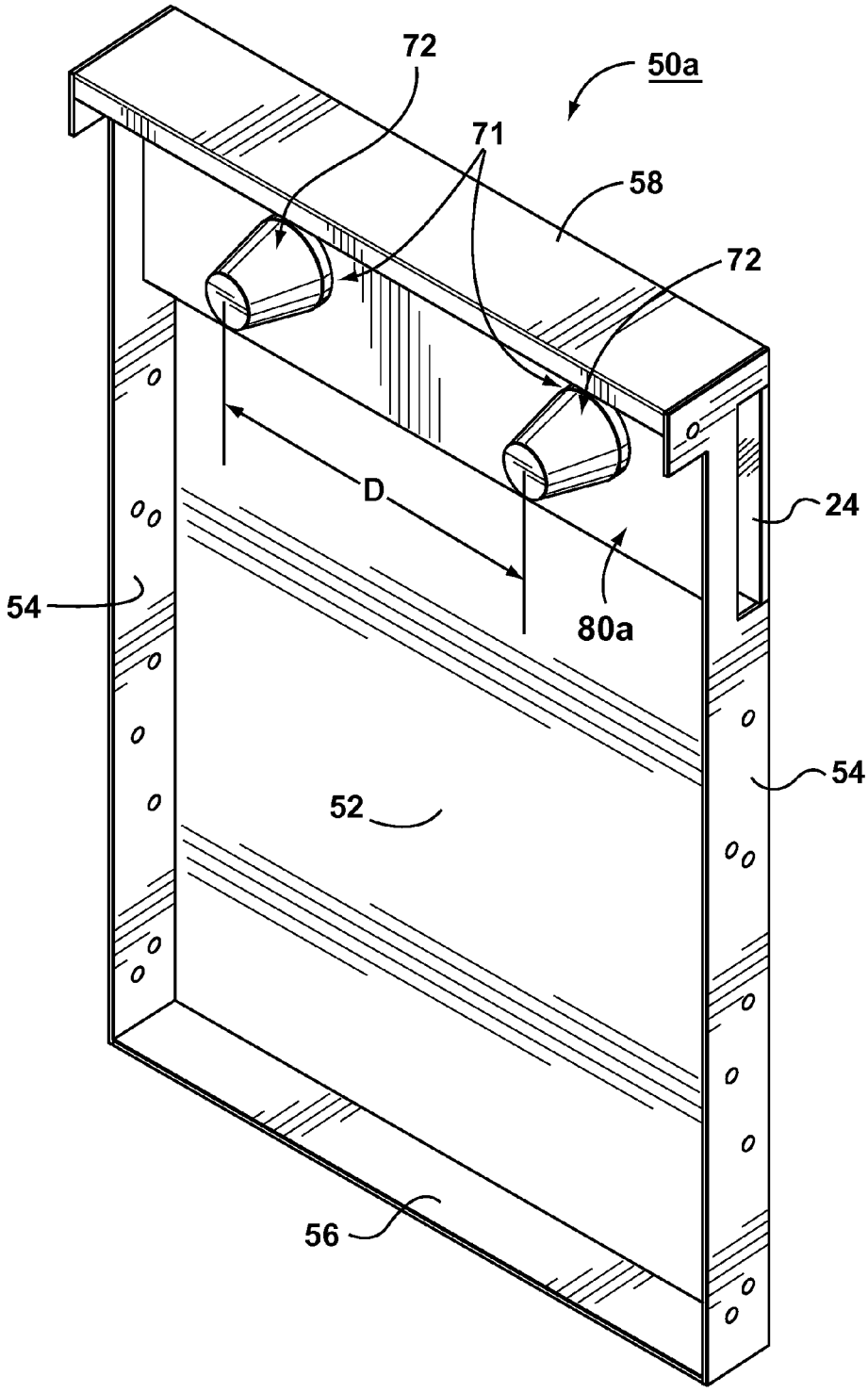
FIG. 8A is a rear perspective view of a panel for forming a swimming pool having a lighting system according to another embodiment with the pot-lights and cover shown.
Figure 8B:
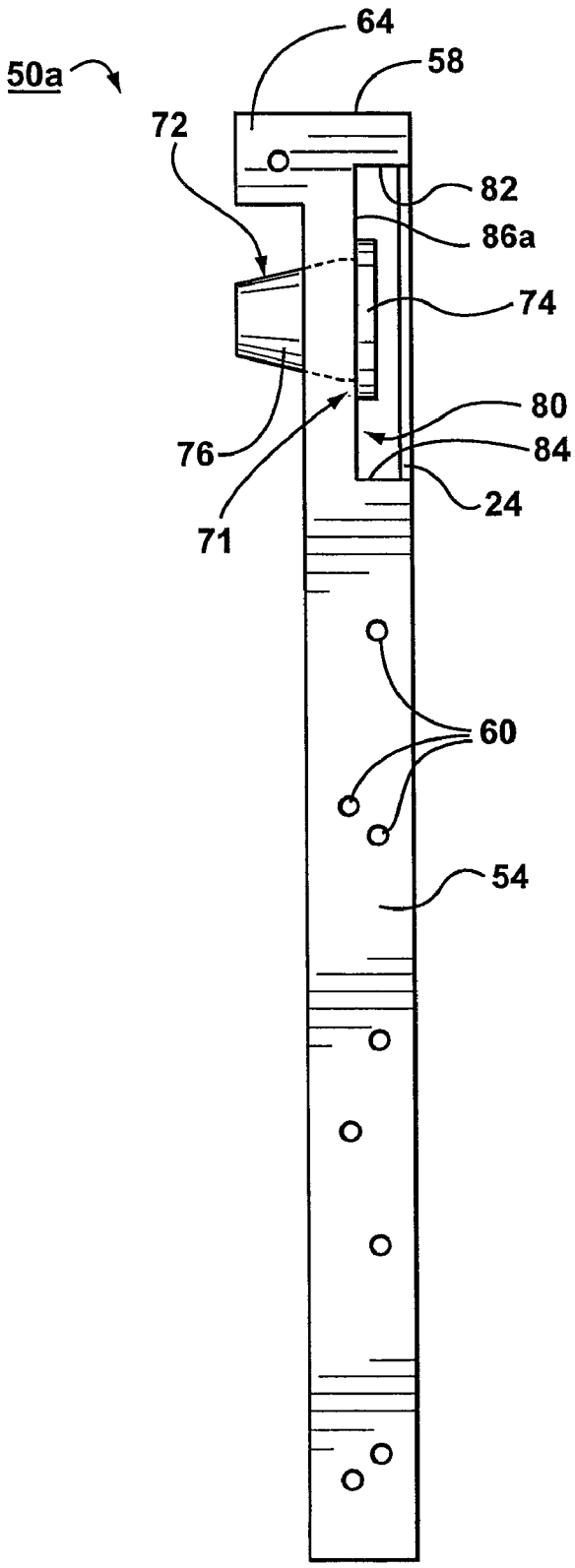
FIG. 8B is a side elevation view of the panel of FIG. 8A.

Turning now to FIGS. 8A and 8B, a panel 50*a* is shown according to another embodiment having pot-lights 72 as lighting sources 22. Panel 50*a* is similar to panel 50, and includes similar features including a front wall 52, side flanges 54, bottom flange 56, top flange 58, holes 60, rear protrusion 64, and recessed portion 80*a* including top wall 82, bottom wall 84 and vertical back wall 86*a*. In this embodiment, back wall 86*a* of panel 50*a* includes a pair of circular openings 71 for receiving the pot-lights 72.

The pot-lights 72 comprise a fixture having a forward portion 74 that extends forwardly through the openings 71 from the back wall 86*a* and into the recessed portion 80*a*. The pot-lights 72 also include a rear portion 76 that extends rearwardly from the openings 71 in the back wall 86*a* of the panel 50*a* into the backfill 26. The pot-lights 72 are spaced apart a pre-determined distance D (as shown in FIG. 8A) to provide illumination of the light-transmitting portion 16 of the liner 14 that is generally uniform across the light-transmitting portion 16 of the liner 14 during use. In other embodiments, the pre-determined distance D can be larger or smaller to provide non-uniform lighting of the light-transmitting portion 16 of the liner 14.

Referring again to FIGS. 1-4, installation of the swimming pool 10 will now be generally described according to one embodiment.

First, a suitable ground surface G must be provided. In some embodiments, such as where the swimming pool 10 is an in-ground pool, the ground surface G can be prepared by excavating soil from a particular location to a pre-determined depth. In other embodiments, such as where the swimming pool 10 is an above-ground pool, excavation may not be required.

In some embodiments, it is generally desirable that the ground surface G be level to provide a uniform depth to the swimming pool 10. In other embodiments, when different depths are desired in different regions of the swimming pool 10, the ground surface G can be provided with different portions having different elevations and slopes according to the design of a particular swimming pool 10. For example, it may be desirable to provide the swimming pool 10 with a deep end having a deeper ground surface G and a shallow end having a shallower ground surface G. It will of course be appreciated that varying the depth of the swimming pool 10 at various locations may require the use of sidewall portions 20 having different sizes, shapes, and lengths to provide a generally uniform upper surface around the perimeter P of the swimming pool 10.

After preparing the ground surface G, the sidewall members 20 are erected vertically to define the perimeter P of the swimming pool 10. In some embodiments, such as where the sidewall members 20 comprise one or more panels 50, the panels 50 can be interconnected by joining adjacent flange members 54 using fasteners in holes 60, or other suitable techniques.

Once the sidewall members 20 have been erected vertically, braces 27 can then be installed to provide lateral support to the sidewall members 20. In some embodiments, backfill 26 can be provided behind the sidewall members 20 in additional to, or as an alternative to, the braces 27 to provide additional structural support.

Once the sidewall members 20 are erected and sufficiently supported, the lighting system 12 can be installed. In some embodiments, the lighting sources 22 will then be installed in the housings 28. In some embodiments, such as where the lighting sources 22 comprise LED modules 40, this may require running electrical wires (such as wires 46) from the lighting sources 22 to an electrical power source via the "channel" C or an alternative pathway, such as through the backfill 26. Once the lighting sources 22 have been installed, the cover plate 24 can then be placed over the opening of the housings 28 and secured in place using, for example, adhesive, screws, snap fittings, or other suitable fasteners.

After installing the lighting system 12, the liner 14 can be installed in the swimming pool 10. The liner 14 is installed over the sidewall members 20 by engaging the liner 14 with the liner contact surface 23 such that the light-transmitting portion 16 registers at least partially with the lighting system 12. Liner 14 is then secured in place by attachment to the perimeter P of the swimming pool 10 using techniques as known in the art. Once the liner 14 has been installed, the swimming pool 10 can be filled with a pre-determined amount of water W.

In some embodiments, there may be several light-transmitting portions 16 located at different locations on the liner 14 such that the lighting system 12 provides illumination to the swimming pool 10 by selectively backlighting different light-transmitting portions 16 of the liner 14.

When there is a need to service the back-lighting apparatus 21, such as to replace the light source 22, the back-lighting apparatus 21 can be accessed by detaching liner 14 from the liner contact surface 23 of the sidewall portion 20. For example, the liner 14 can be pulled back to expose the cover 24, which can then be removed. The light sources 22 can then be accessed for servicing and replacement via the opening in the housing 28.

In some embodiments, one or more of the walls 30*a*, 30*b*, 31 may include a reflective coating to enhance illuminative characteristics of lighting apparatus 10. Walls 30*a*, 30*b*, 31 can also have a non-planar shape to assist in directing the light generated by the light sources 22 towards the light-transmitting portion 16 of the liner 14. For example, the walls 30*a*, 30*b*, 31 may be elliptical or parabolic in shape to focus light towards the light-transmitting portion 16.

In some embodiments, the walls 30*a*, 30*b*, 31 may be configured to direct light at a slight downward angle towards the bottom B of the swimming pool 10 to assist in improving illumination of the swimming pool 10 in low ambient lighting. In other embodiments, the walls 30*a*, 30*b*, 31 may be configured to direct light at a slight upward angle away from the bottom B of the swimming pool 10.

What has been described is merely illustrative of the application of some embodiments of the invention. Other systems, apparatus and methods can be implemented by those skilled in the art without departing from the present invention, the scope of which is defined by the following claims.

The invention claimed is:

1. A lighting system for a swimming pool, comprising:

a) a sidewall sized and shaped to define a perimeter of the swimming pool;

b) a liner for covering the sidewall and a bottom of the swimming pool, the liner being made from a material suitable for creating a watertight cavity for receiving water, the liner including a light-transmitting portion, the light-transmitting portion being made of the material; and c) a back-lighting apparatus connected to the sidewall and located behind the light-transmitting portion of the liner, the back-lighting apparatus being configured to transmit light through the light-transmitting portion of the liner to illuminate the swimming pool;

d) wherein the back-lighting apparatus comprises at least one housing connected to the sidewall behind the liner, the at least one housing having an opening positioned to register with the light-transmitting portion of the liner, at least one light source sized and shaped to fit within the housing for emitting light through the opening of the housing, and a light-transmitting cover shaped to cover the opening of the housing to protect the light source, wherein the light emitted from the light source is transmitted through the light-transmitting cover and the light-transmitting portion of the liner to illuminate the swimming pool; and e) wherein the sidewall comprises a plurality of interconnected panels, each panel having a liner contact surface for engaging the liner and a recessed portion that defines the at least one housing.

2. The lighting system of claim 1, wherein the recessed portion includes a ledge for receiving the light-transmitting cover.

3. The lighting system of claim 1, wherein the back-lighting apparatus is configured to provide a generally continuous distribution of light around at least a portion of a perimeter of the swimming pool.

4. A lighting system for a swimming pool, comprising:

a) a sidewall sized and shaped to define a perimeter of the swimming pool;

b) a liner for covering the sidewall and a bottom of the swimming pool, the liner being made from a material suitable for creating a watertight cavity for receiving water, the liner including a light-transmitting portion, the light-transmitting portion being made of the material; and c) a back-lighting apparatus connected to the sidewall and located behind the light-transmitting portion of the liner, the back-lighting apparatus being configured to transmit light through the light-transmitting portion of the liner to illuminate the swimming pool;

d) wherein the back-lighting apparatus comprises at least one housing connected to the sidewall behind the liner, the at least one housing having an opening positioned to register with the light-transmitting portion of the liner, at least one light source sized and shaped to fit within the housing for emitting light through the opening of the housing, and a light-transmitting cover shaped to cover the opening of the housing to protect the light source, wherein the light emitted from the light source is transmitted through the light-transmitting cover and the light-transmitting portion of the liner to illuminate the swimming pool; and e) wherein the at least one housing defines a channel extending around at least a portion of a perimeter of the swimming pool, and the at least one light source is housed in the channel to provide a generally continuous distribution of light around at least a portion of the perimeter of the swimming pool.

5. A back-lighting apparatus for a swimming pool having a sidewall defining a perimeter of the swimming pool and a waterproof liner for covering the sidewall, comprising:

a) at least one housing connected to the sidewall, the housing being located behind the liner, the housing having an opening positioned to register with a light-transmitting portion of the liner;

b) at least one light source shaped and sized to fit within the housing for emitting light through the opening of the housing; and c) a light-transmitting cover shaped to cover the opening to protect the at least one light source, wherein the light emitted from the at least one light source is transmitted through the light-transmitting cover and the light-transmitting portion of the liner to illuminate the swimming pool;

d) wherein the at least one housing defines a channel extending around at least a portion of the perimeter of the swimming pool, and the at least one light source is housed in the channel to provide a generally continuous distribution of light around at least a portion of the perimeter of the swimming pool.

6. A back-lighting apparatus for a swimming pool having a sidewall defining a perimeter of the swimming pool and a waterproof liner for covering the sidewall, comprising:

a) at least one housing connected to the sidewall, the housing being located behind the liner, the housing having an opening positioned to register with a light-transmitting portion of the liner;

b) at least one light source shaped and sized to fit within the housing for emitting light through the opening of the housing; and c) a light-transmitting cover shaped to cover the opening to protect the at least one light source, wherein the light emitted from the at least one light source is transmitted through the light-transmitting cover and the light-transmitting portion of the liner to illuminate the swimming pool;

d) wherein the light-transmitting portion of the liner includes a decorative pattern having portions of varying light transmittance; and e) wherein the sidewall comprises a plurality of interconnected panels, wherein each of the panels comprises a recessed portion defining the housing, the recessed portion being shaped for receiving the light-transmitting cover.

7. The back-lighting apparatus of claim 6, wherein the light-transmitting portion of the liner is positioned proximate a water line when the swimming pool contains a pre-determined amount of water, such that an upper portion of the light-transmitting cover is above the waterline and a lower portion of the light-transmitting cover is below the water line.

8. The back-lighting apparatus of claim 6, wherein the at least one light source comprises at least one LED module.

9. The back-lighting apparatus of claim 6, wherein the light-transmitting cover comprises a panel of translucent or transparent material.

10. A system for forming an illuminated swimming pool, the swimming pool having a waterproof liner for creating a watertight cavity for receiving water, comprising:

a) a plurality of panels shaped to be interconnected to form a sidewall of the swimming pool, each of the panels comprising a front wall defining a liner contact surface for engaging the liner, and a recessed portion connected to and offset from the front wall, the recessed portion being located behind the contact surface and having an opening positioned to register with a light-transmitting portion of the liner;

b) at least one light source sized and shaped to fit within the recessed portion of each panel for emitting light through the opening; and c) a light-transmitting cover shaped to cover the opening of the recessed portion to protect the light source, wherein the light emitted from the light source is transmitted through the light-transmitting cover and the light-transmitting portion of the liner to illuminate the swimming pool;

d) wherein each panel further comprises vertical side flanges extending rearwardly from side edges of the front wall, the vertical side flange configured for interconnecting the panels together to form a perimeter of the swimming pool.

11. A system for forming an illuminated swimming pool, the swimming pool having a waterproof liner for creating a watertight cavity for receiving water, comprising:

a) a plurality of panels shaped to be interconnected to form a sidewall of the swimming pool, each of the panels comprising a front wall defining a liner contact surface for engaging the liner, and a recessed portion connected to and offset from the front wall, the recessed portion being located behind the contact surface and having an opening positioned to register with a light-transmitting portion of the liner;

b) at least one light source sized and shaped to fit within the recessed portion of each panel for emitting light through the opening; and c) a light-transmitting cover shaped to cover the opening of the recessed portion to protect the light source, wherein the light emitted from the light source is transmitted through the light-transmitting cover and the light-transmitting portion of the liner to illuminate the swimming pool;

d) wherein the recessed portions of the panels define a channel extending around at least a portion of the perimeter of the swimming pool and the at least one light source is housed in the channel to provide a generally continuous distribution of light around at least a portion of the perimeter of the swimming pool.

* * * * *